United States Patent [19]

Jones

[11] Patent Number: 4,852,941

[45] Date of Patent: Aug. 1, 1989

[54] ADJUSTABLE DEBRIS TRAY ASSEMBLY FOR PODIATRY CHAIRS

[75] Inventor: Larry Jones, Sidney, Ohio

[73] Assignee: Midmark Corporation, Versailles, Ohio

[21] Appl. No.: 222,852

[22] Filed: Jul. 22, 1988

[51] Int. Cl.[4] ..... A61G 15/00

[52] U.S. Cl. ..... 297/188; 297/192; 297/423

[58] Field of Search ..... 297/144, 182, 188, 192, 297/430, 431, 435, 423

[56] References Cited

U.S. PATENT DOCUMENTS

| | | | |
|---|---|---|---|
| 2,519,771 | 8/1950 | Lacore | 297/437 X |
| 2,635,680 | 4/1953 | Zentmire | 297/144 |
| 2,954,955 | 10/1960 | Feller | 297/188 X |
| 3,096,059 | 7/1963 | Johnson | 248/162 |
| 3,104,402 | 9/1963 | Johnson | 5/331 |
| 3,145,053 | 8/1964 | Thompson et al. | 297/383 |
| 3,146,592 | 9/1964 | Johnson | 60/52 |
| 3,147,946 | 9/1964 | Hale | 248/404 |
| 3,179,369 | 4/1965 | Hale | 248/404 |
| 3,197,852 | 8/1965 | Johnson | 29/446 |
| 3,218,804 | 11/1965 | Johnson | 60/52 |
| 4,372,605 | 2/1983 | Cervantes | 297/192 |

FOREIGN PATENT DOCUMENTS

| | | | |
|---|---|---|---|
| 2304437 | 8/1973 | Fed. Rep. of Germany | 297/188 |

*Primary Examiner*—Peter R. Brown

*Attorney, Agent, or Firm*—Biebel, French & Nauman

[57] ABSTRACT

Podiatry chair having a debris tray slidably positioned adjacent the chair foot section. The debris tray is mounted on and carried by a bracket having a pair of forwardly extending arms having grooves formed therein. Knurled torque knobs are threaded through the bracket arm grooves and are received in threaded apertures formed in the tray sidewalls to provide for angular adjustment and positioning of the debris tray in an infinite number of angular positions relative to the chair foot section.

3 Claims, 6 Drawing Sheets

ADJUSTABLE DEBRIS TRAY ASSEMBLY FOR PODIATRY CHAIRS

BACKGROUND OF THE INVENTION

The present invention pertains to podiatry chairs of the type wherein a chair leg section is adapted to receive and hold the patient's legs and feet so that the desired procedure may be applied thereto by the podiatrist. A debris tray member is slidably connected to the foot section so that it may be adjusted in its position toward and away from the podiatry foot section so as to accommodate differing body heights and shapes. The debris tray is adapted to collect foot clippings and the like resulting from performance of the desired foot procedure on the patient by the podiatrist.

There is a need in the art for the provision of such a debris tray that may be angularly adjusted relative to the chair foot section so as to accommodate differing foot positions while still performing the intended function of serving as a receptacle for foot clippings resulting from performance of the requisite podiatric procedure. There is an even more specific need in the art for the provision of a debris tray which not only can be angularly adjusted in an infinite number of positions relative to the foot section member, but can also be readily removed so that the podiatrist may discard the waste material and sterilize the tray prior to subsequent use.

SUMMARY OF THE INVENTION

These and other objects are met by the invention herein. Basically, a podiatry chair is provided which includes a foot section member that is slidably connected to a mid-section chair member. The mid-section chair member is adapted to receive the buttocks portion of the patient whereas the foot section is, of course, adapted to receive and hold the legs and feet of the podiatry patient. A debris tray is connected to a bracket which is slidably disposed along a pair of longitudinally extending rod members fixedly secured to the foot section frame. The debris tray is connected to the bracket through groove members formed in two longitudinally extending arms of the bracket by the provision of knurled torque knobs which are threaded into apertures formed on opposed sidewall members of the debris tray. Due to the provision of the knurled torque knobs, and grooves formed in the forwardly extending arms of the debris tray bracket, the debris tray position may be varied in an infinite number of angular positions relative to the foot section. The debris tray may be readily removed from the bracket by simply unscrewing the knurled torque knobs. Of course, the desired angular position of the debris tray relative to the foot section may be secured by tightening the torque knobs.

The invention will be further described in the following detailed description, the accompanying drawings, and the appended claims.

DETAILED DESCRIPTION OF THE INVENTION

Figure 1:
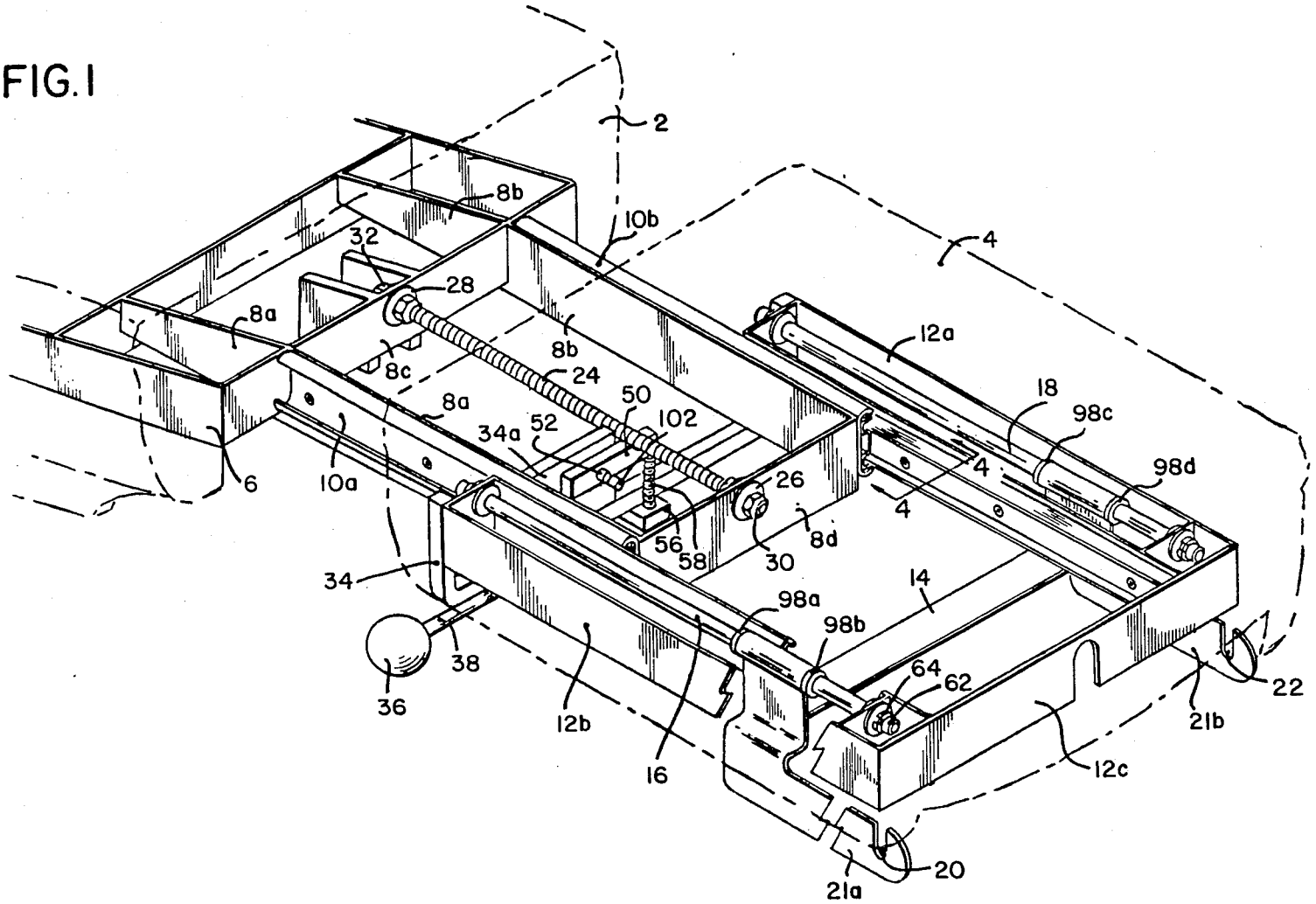
FIG. 1 is a perspective view of the podiatry chair apparatus with certain portions being cut away for better clarity.

Turning now to the drawings and specifically to FIG. 1 thereof, there is shown a podiatry chair having a first section member 2 (here a mid-section member) and a second section 4 (here designated as the foot section). Midsection 2 is supported on frame member 6 via conventional attachment means which do not play a part of the present invention and hence have been omitted for clarity. The midsection frame member 6 comprises integral midsection track supports defined by side members 8*a*, 8*b*, first transverse support 8*c* and second transverse support 8*d*. As shown, side members 8*a*, 8*b* are angled at a slope of about 12° downwardly from frame 6 so as to readily facilitate comfortable reception of the patient's legs on top of member 4. Even when provided with such an angle, members 2 and 4 can be viewed as being substantially coplanar. Fixedly attached to track support sides 8*a* and 8*b* are rail members 10*a* and 10*b* which extend along the length of side support members 8*a* and 8*b* and extend in parallel manner generally longitudinally from midsection 2.

Figure 2:
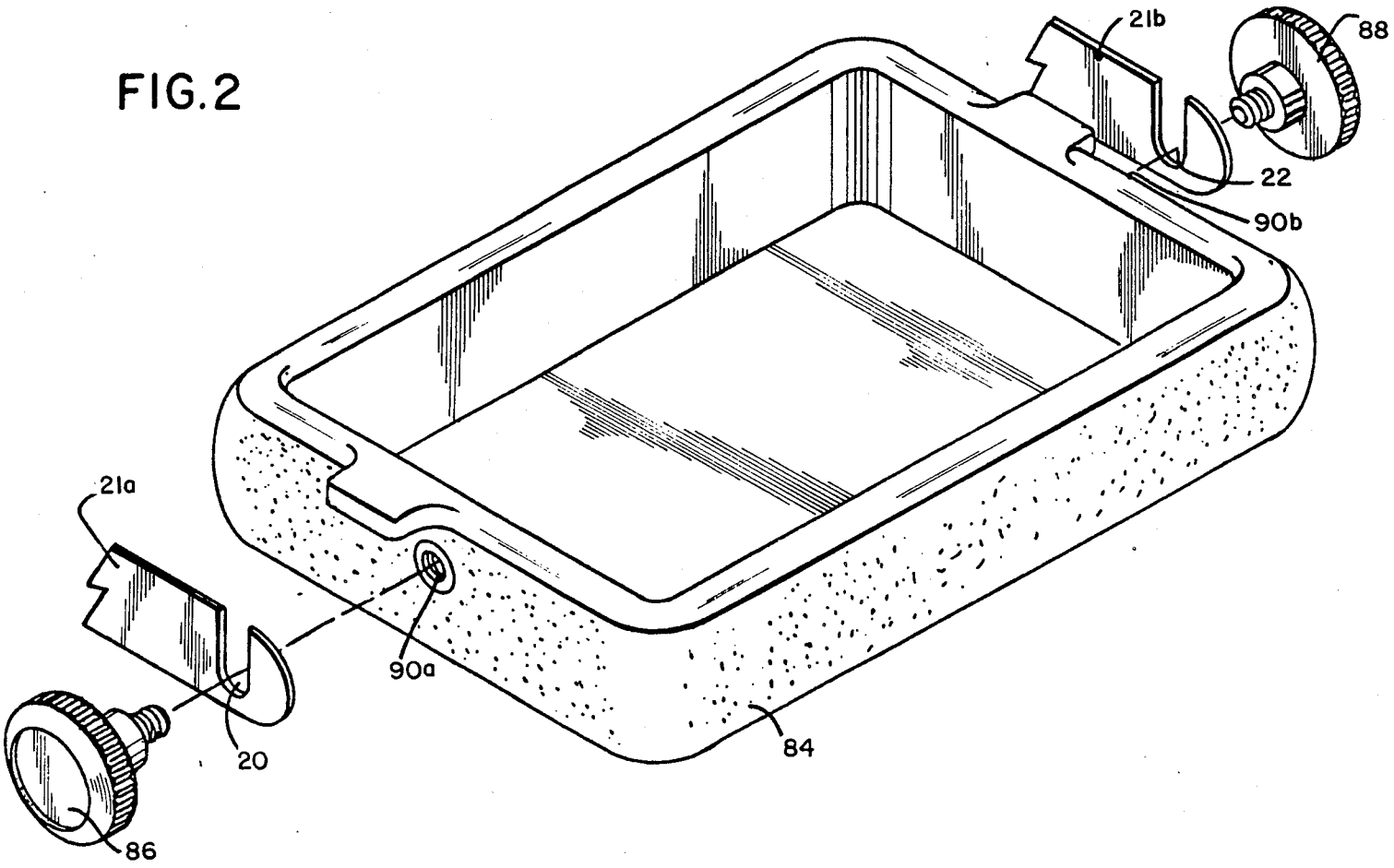
FIG. 2 is a perspective view of the debris tray showing the means for mounting of same to the longitudinally extending arms of the slidable bracket member.
Figure 3:
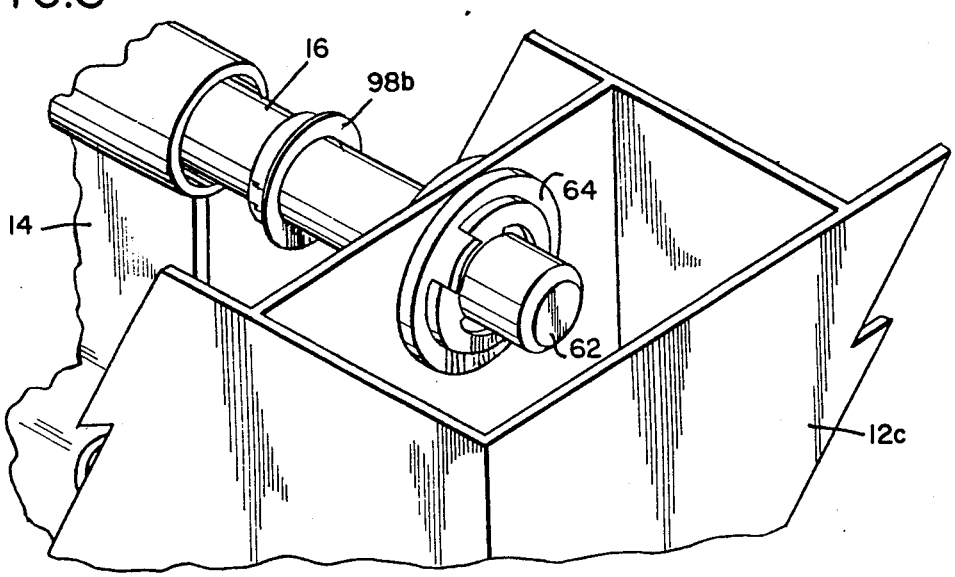
FIG. 3 is an enlarged view in perspective showing the attachment of the debris tray rods upon which the bracket is mounted to provide for sliding movement of the debris tray.
Figure 6:
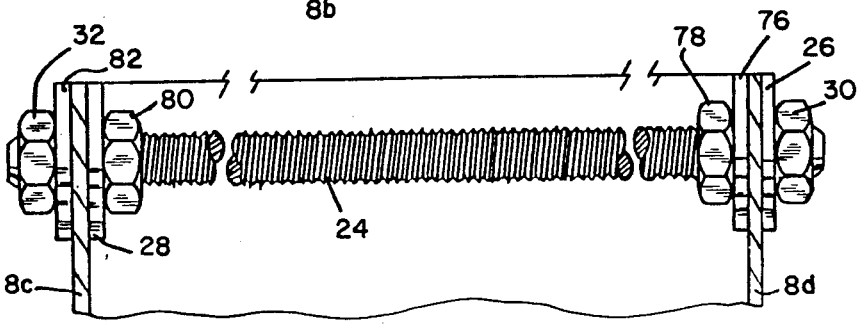
FIG. 6 is a top schematic view of the brake rod showing its attachment to the frame support of the mid-section of the chair.
Figure 5:
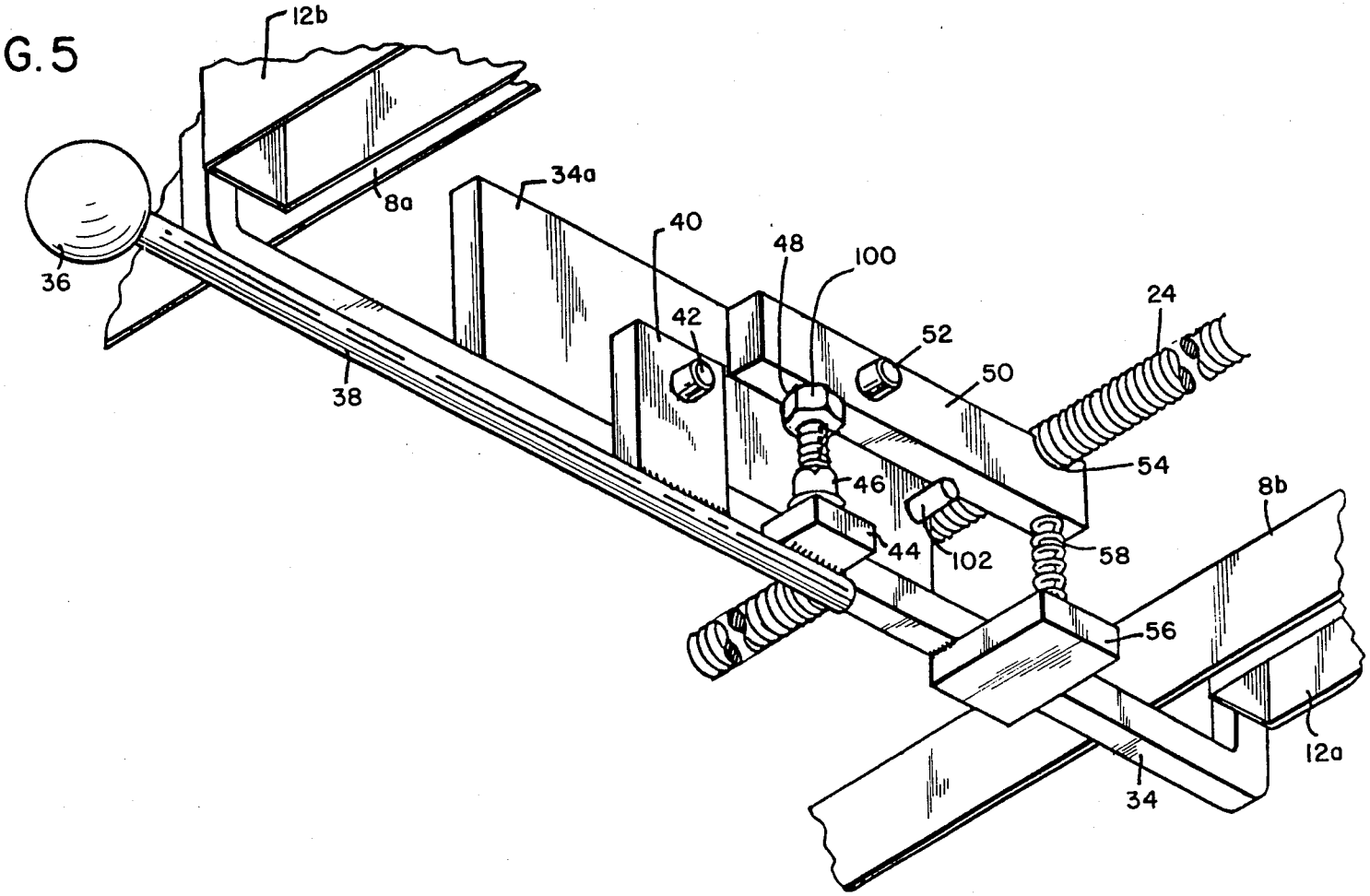
FIGS. 5 and 5*a* are perspective views of a brake assembly which may be utilized in order to arrest sliding movement of the chair foot section relative to the mid-section of the chair.
Figure 5A:
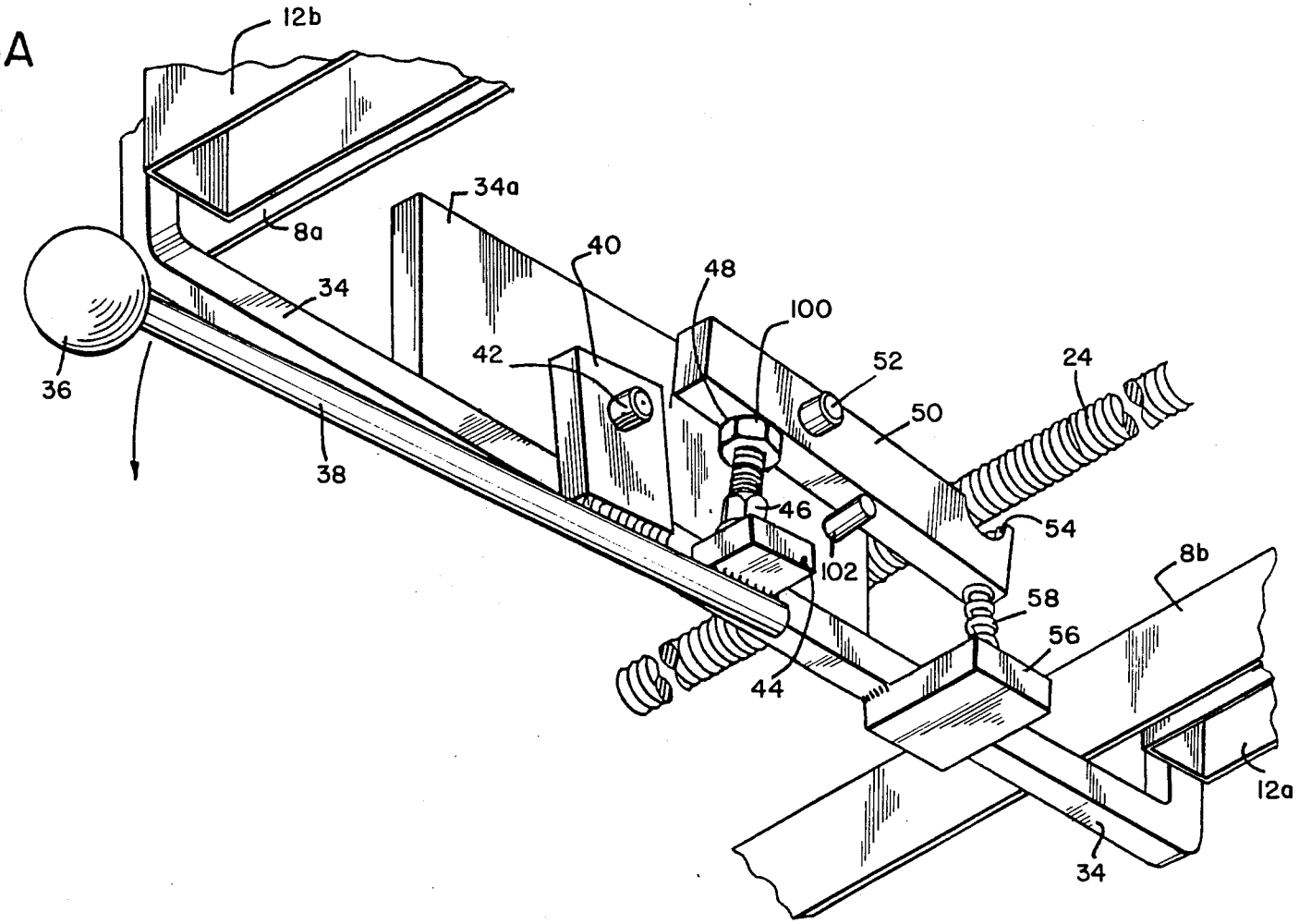
Figure 8:
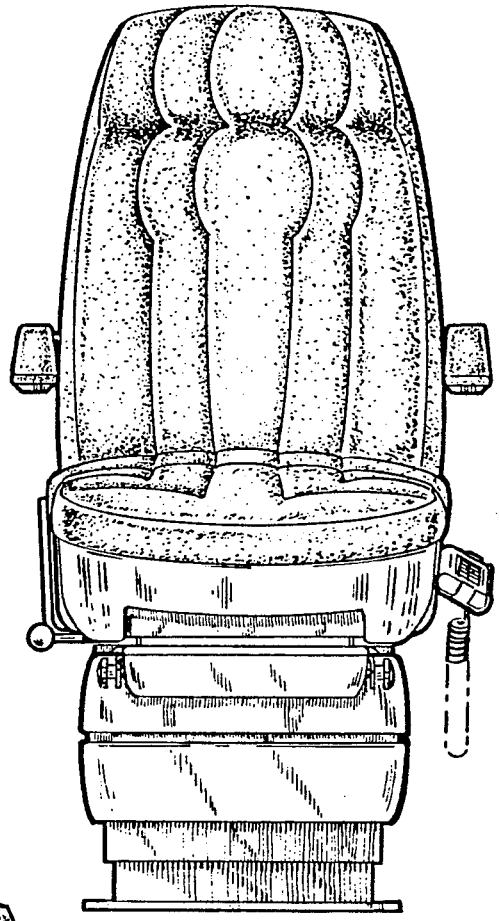
FIG. 8 is a front end view of the podiatry chair shown in FIG. 7.
Figure 7:
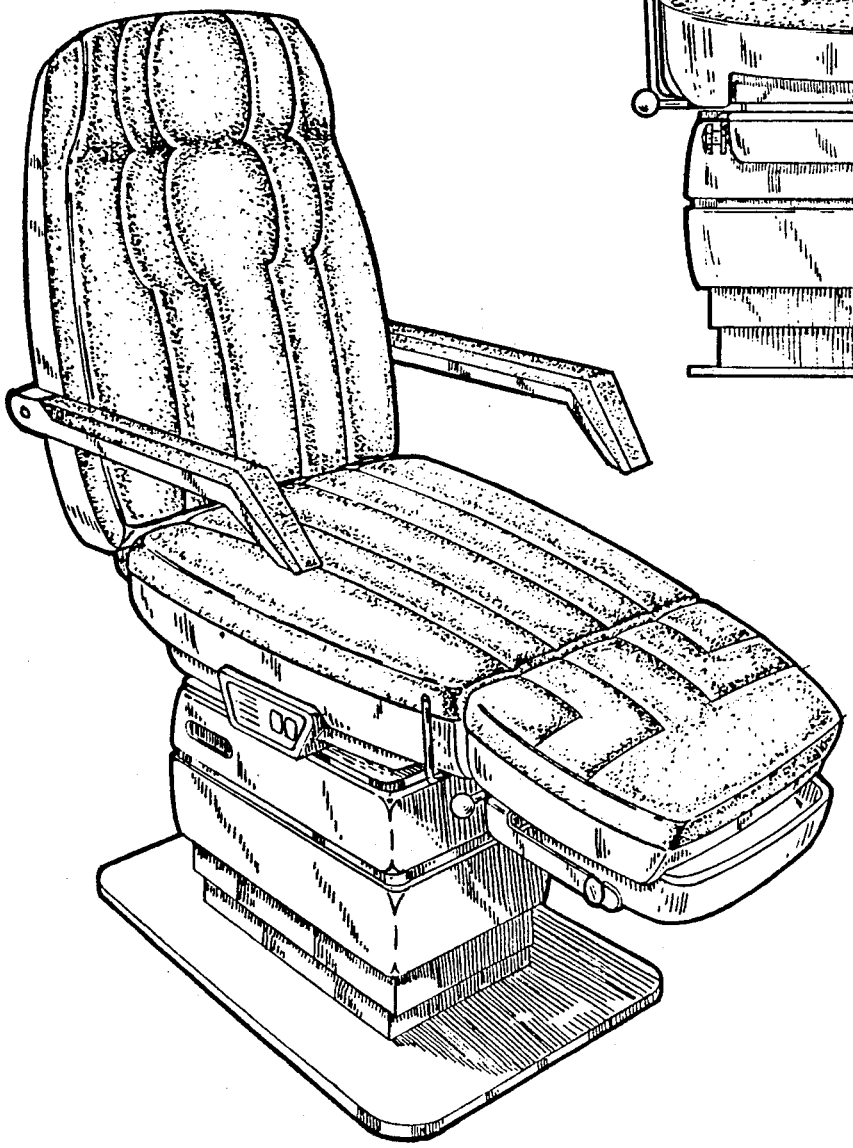
FIG. 7 is a perspective view taken from the right front side of a podiatry chair incorporating the debris tray invention.

Foot section 4 is attached to and carried by framing members defined by sides 12*a*, 12*b*, and front section 12*c*. Again, the foot section 4 is attached to its associated frame work via conventional means which need not be detailed herein. Debris tray support bracket 14 is slidably received over rod members 16, 18, which rod members are fixedly secured to frames 12*a*, 12*b*, and 12*c* as shown by the provision of nut cap 62 and lock washer 64 (see FIG. 3). Snap-fit bearings 98*a*–*d* are provided in the two tubular portions of bracket 14 to facilitate sliding of bracket 14 along rod members 16,18. Grooves 20, 22 are formed in the forwardly extending arms 21*a*, 21*b* of tray support bracket 14 and are adapted to receive knurled torque knobs 86, 88 (see FIG. 2) so as to attach debris tray 84 to the foot section frame. Attachment of debris tray 84 via torque knobs 86, 88 which are received in threaded apertures 90*a*, 90*b* formed in sidewalls 92, 94 of the debris tray provides for easy removal of the tray so that the contents thereof may be discarded. Also, the tray can be infinitely angularly adjusted with respect to the forwardly extending arms 21*a*, 21*b* of debris tray Turning once again to FIG. 1 as well as to FIGS. 5 and 5*a*, there is shown a brake rod 24, which is an elongated threaded rod member fixedly attached to first transverse section 8*c* of the midsection track support and second transverse section 8*d* of the track support by the provision of nuts and washers (FIG. 6). As can be seen in FIG. 6, rod 24 is fixedly mounted to track supports 8c and 8d via the provision of nuts 30, 78, 80, and 32 and washers 82, 28, 76, and 26. A brake support bracket 34 is fixedly secured to foot section frame sides 12a, 12b by welding or the like. The bracket 34 includes pivot block section 34a (see especially FIGS. 5 and 5a). Brake knob 36 attached to brake actuating lever 38 is pivotally attached to pivot block section 34a by the provision of brake land member 40 which is integral with lever 38. The knob 36 and associated lever 38 can be pivoted about pivot 42. The lever 38 also comprises an integral lever pad 44. Bar member 50 is attached to pivot block section 34a via the provision of pivot pin 52. Threadably received within threaded aperture 48 is carriage bolt 46 which is carried by bar member 50 and secured in aperture 48 by locknut 100. Bar 50 also comprises semicircular threaded groove member 54 which is adapted to threadingly mate with brake rod 24 to arrest sliding motion of section member 4 relative to section member 2. Spring support cup 56 welded to brake support bracket 34 receives a spring member 58 therein and is received within a bore 60 formed in bar 50. As shown in FIG. 5, the spring 58 normally biases the bar 50 and associated threaded groove member 54 into engagement with brake rod 24. Stop 102 is integral with pivot block section 34a.

Figure 4:
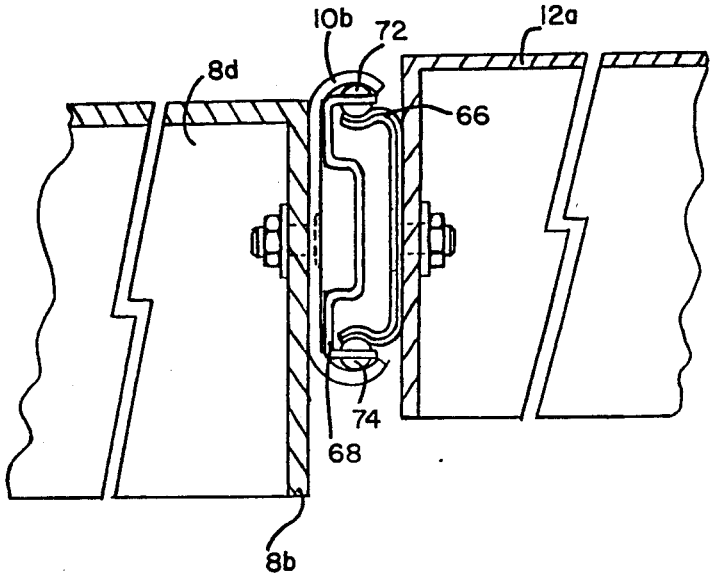
FIG. 4 is a sectional view taken along the lines and arrows 4—4 shown in FIG. 1.

Turning now to consideration of FIGS. 1 and 4, sliding motion of section member 4 relative to section 2 is provided by means of rails 10a, 10b attached to midsection track support sides 8a and 8b respectively. Rail guide 68 is received within tracks 10a and 10b and is adapted to slidably receive channel 66 which is attached to foot section frame sides 12a and 12b. Bearings 72 and 74 attached to rail guide 68 facilitate sliding movement of framing sides 12a and 12b relative to rails 10a and 10b thus providing for sliding movement of foot section 4 relative to chair or table midsection 2.

In operation, the patient's buttocks portion is received in podiatry chair midsection 2. A back section (not shown) is generally perpendicularly disposed with respect to midsection 2. As is usual in the art, the inclination of the back member relative to the mid-section can be varied via hydraulics or similar controls. The patient's legs and feet extend over foot section 4. In order to accommodate and adjust for larger and/or smaller patients, the foot section 4 may be slidably moved toward and away from midsection 2 via the rail members 10a, 10b and associated roller mechanisms. As shall be apparent, such sliding motion is only permitted when the brake is in its disengaged position.

Turning specifically to FIG. 5 hereof, there is shown the brake in its engaged position in which sliding movement of foot section 4 relative to midsection 2 is prohibited. In FIG. 5, it can be seen that spring member 58 biases bar 50 into threaded engagement with brake rod 24. In order to disengage the brake member, and as clearly shown in FIG. 5a, the operator pushes downwardly on brake actuation knob 36 which in turn causes lever pad 44 to abut carriage bolt 46 through the action of pivot 42. Carriage bolt 46, in its upward thrust, causes threaded groove member 54 to move downwardly, out of engagement with brake rod 24 against the yielding resistance of spring member 58. Stop 102 limits the pivoting motion of bar 50 away from rod 24. After the desired position of the members 2, 4, is obtained, the operator may simply release knob 36 whereby spring member 58 will bear against bar 50 moving it upwardly at threaded groove portion 54 so as to engage with threaded brake rod 24 to arrest sliding movement of section 2 relative to section 4.

The podiatrist may slidably adjust debris tray 84 along rods 16, 18 so as to properly position the debris tray in its proper position for the particular podiatric procedure to be accomplished. The angular disposition of debris tray 84 relative to chair foot section 4 may be infinitely varied by simply loosening the torque knobs 86, 88, adjusting the tray in its desired position, and re-tightening the knobs. Additionally, when the debris tray is full of foot matter wastage, the podiatrist simply unscrews knobs 86, 88, and removes the tray to dump the wastage in the trash. The tray may then be sterilized prior to subsequent usage.

It is to be understood that the invention is not limited to the particular form of apparatus herein described and claimed, and that changes may be made therein without departing from the scope of the invention which is defined in the appended claims.

What is claimed is:

1. In a podiatry chair of the type having a foot section member adapted to receive and hold the legs and feet of a patient and a debris tray slidably connected to said foot member and adapted to receive debris clippings from a foot or feet of said patient, the improvement comprising adjustable connection means connecting said debris tray to said foot section member for providing infinite angular positioning of said debris tray relative to said foot section member, wherein said adjustable connection means comprises a bracket means slidably connected to said foot section member, said bracket means comprising a pair of outwardly extending arm members, each said arm being provided with a groove therein, said debris tray having a pair of opposed sidewall members having threaded apertures therein, a pair of knurled torque knobs, each said knob being threaded through one of said grooves and received in one of said threaded apertures of said debris tray sidewall members.

2. Podiatry chair comprising a foot section member adapted to receive and hold the legs and feet of a patient, a debris tray adapted to receive debris clippings from a foot or feet of said patient, slidable connection means for slidably connecting said foot section member and said debris tray, said slidable connecting means including a bracket means, said debris tray being carried by said bracket means, and angular adjustment means connected to said debris tray for providing infinite angular adjustment of said debris tray relative to said bracket means about a horizontal axis.

3. Podiatry chair as recited in claim 2 wherein said bracket means comprises a pair of outwardly extending arm members carrying said debris tray and wherein said angular adjustment means provides for infinite angular adjustment of said debris tray relative to said arm members about a horizontal axis.

* * * * *